US005738280A

United States Patent [19]

Ruthenberg

[11] Patent Number: 5,738,280

[45] Date of Patent: Apr. 14, 1998

[54] CENTERFED DEVICE FOR CREATING DECORATIVE WATERFALLS

[76] Inventor: Douglas Ruthenberg, 10453 Tillery Rd., Spring Hill, Fla. 34608

[21] Appl. No.: 699,265

[22] Filed: Aug. 19, 1996

[51] Int. Cl.[6] ..... B05B 17/08

[52] U.S. Cl. ..... 239/17; 239/193

[58] Field of Search ..... 239/16–18, 20, 239/193

[56] References Cited

U.S. PATENT DOCUMENTS

| | | | |
|---|---|---|---|
| 4,334,328 | 6/1982 | Delepine . | |
| 4,355,762 | 10/1982 | Coleman . | |
| 4,396,508 | 8/1983 | Broughton . | |
| 4,399,742 | 8/1983 | Dobias . | |
| 4,404,173 | 9/1983 | Bailey et al. . | |
| 4,881,280 | 11/1989 | Lesikar . | |
| 5,249,744 | 10/1993 | Ruthenberg | 239/17 X |
| 5,608,927 | 3/1997 | Lowry et al. | 239/193 X |

FOREIGN PATENT DOCUMENTS

| | | | |
|---|---|---|---|
| 2641802 | 3/1978 | Germany | 239/193 |

*Primary Examiner*—Lesley D. Morris

*Attorney, Agent, or Firm*—Joseph C. Mason, Jr.

[57] ABSTRACT

A waterfall-producing device includes an elongate housing having an "T" -shaped or "X" -shaped turbulence suppressor positioned within the housing. Water under pressure is introduced into the center of the housing and is constrained to divide into two counterflowing streams that flow to the opposite ends of the housing. The turbulence suppressor divides the interior of the housing into a rearward chamber, a lower chamber, a forward chamber, and an upper chamber. Openings are formed in preselected walls of the turbulence suppressor and are spaced and sized so that the rearward chamber fills first, followed by the lower chamber, forward chamber and upper chamber in sequence. Water escapes the upper chamber through a space between an interior top wall and a rear wall of the housing and then flows to a discharge opening that covers an area substantially equal to the collective areas of the openings formed in each of the turbulence suppressor walls.

10 Claims, 2 Drawing Sheets

CENTERFED DEVICE FOR CREATING DECORATIVE WATERFALLS

FIELD OF THE INVENTION

This invention relates, generally, to devices that create decorative waterfalls. More particularly, it relates to a centerfed waterfall-producing device having a unique turbulence-suppressing means.

BACKGROUND OF THE INVENTION

Devices that create decorative waterfalls generally fall into two categories. In one type, water is fed into opposite ends of the device so that opposing streams collide with one another in the center of the device. The collision substantially reduces the turbulence of the water so that the resulting waterfall is in the form of a relatively smooth sheet of water.

In another type, water is centerfed into a housing. The incoming stream is constrained to split into two streams that initially flow away from one another. Structure or buffering means is provided to cause the two counterflowing streams to reverse their respective courses and to collide with one another, thereby reducing the turbulence of the water that exits the device in the form of a waterfall.

The centerfed device is preferable over the endfed device because it has less parts, fewer joints, is easier to assemble, and requires only one connection between the water source and the device. However, its housing is somewhat bulkier than the endfed housings. What is needed, then, is a centerfed device having less bulkier housing, but which maintains the centerfed features of fewer parts and fewer joints.

However, in view of the art at the time the present invention was made, it was not obvious to those of ordinary skill in this art how the needed device could be provided.

SUMMARY OF THE INVENTION

The long-standing but heretofore unfulfilled need for an improved decorative centerfed waterfall-producing device is now met by a new, useful, and nonobvious invention. The present invention includes a device for producing decorative waterfalls, including an elongate housing. The elongate housing includes a rear wall, a bottom wall, a forward wall, a top wall, an interior top wall disposed in spaced apart, parallel relation to said top wall, and a pair of end walls. The interior top wall has a trailing edge disposed in spaced relation to the housing rear wall and a leading edge disposed in juxtaposition to a leading edge of the housing top wall. An elongate water discharge space is defined between the leading edge of the top wall and the leading edge of the interior top wall. In similar spatial relationship, the housing may be square, rectangular, oval, or circular, such as a pipe.

An elongate, "X"-shaped turbulence suppressor is disposed within the housing. It includes a lower rearward wall, a lower forward wall, an upper rearward wall, and an upper forward wall.

A rearward chamber is defined by the lower rearward and upper rearward walls of the turbulence suppressor and the rear wall of the housing. A lower chamber is defined by the lower rearward and lower forward walls of the turbulence suppressor and the bottom wall of the housing. A forward chamber is defined by the lower forward and upper forward walls of the turbulence suppressor and the forward wall of the housing, and an upper chamber is defined by the upper rearward and upper forward walls of the turbulence suppressor and the interior top wall of the housing. The turbulence suppressor, which is disposed within the housing, also may be "t" (tee)-shaped for purposes of this invention, so long as similar wall relationship and configuration is maintained as described herein with respect to the "X"-shaped turbulence suppressor.

Water from a source of water under pressure initially enters the rearward chamber and is constrained to flow into the lower chamber through openings formed in the lower rearward wall of the turbulence suppressor because the upper rearward wall of said turbulence suppressor is imperforate. Water then flows into the forward chamber through openings formed in the lower forward wall of the turbulence suppressor, into the upper chamber through openings formed in the upper forward wall, through the space between the trailing edge of the interior top wall of the housing and the rear wall of the housing, and through the discharge opening.

The openings in the lower rearward wall have a collective area which may be substantially equal or different in area to the area of the discharge opening. The openings in the lower forward wall also have a collective area which may be substantially equal or different in area to the area of the discharge opening, as will the openings in the upper forward wall.

The openings in the lower rearward wall have a common area and are equidistantly spaced apart by a predetermined distance.

The openings in the lower forward wall may be circular, semi-circular, or slotted and may have a common area less than the common area of the openings in the lower rearward wall. The circular and semi-circular openings may be equidistantly spaced apart from one another by a predetermined distance that is less than the predetermined distance between similar-type openings in the lower rearward wall.

The openings in the upper forward wall may be circular, semi-circular or slotted and may have a common area less than the common area of the openings in the lower forward wall. The circular and semi-circular openings may be equidistantly spaced apart from one another by a predetermined distance that is less than the predetermined distance between similar-type openings in said lower forward wall.

The openings in the lower rearward wall may be positioned near a lower portion, preferably near the lower edge of said wall. The openings in the lower forward wall may be positioned near an upper portion, preferably near the upper edge thereof. The openings in the upper forward wall may be positioned near an upper portion, preferably near the upper edge of said wall.

The upper rearward wall is imperforate. Accordingly, water introduced into the device through the inlet pipe enters the rearward chamber initially and is constrained to flow into the lower chamber through the relatively large and relatively widely spaced apart openings formed in said lower rearward wall. Preferably, said openings are formed near the lower edge of said lower rearward wall so that the lower chamber is filled from the bottom. The water is then constrained to flow from the lower chamber into the forward chamber through the relatively smaller and relatively more closely spaced openings formed in the lower forward wall, preferably said openings being formed in said lower forward wall near an upper edge thereof so that said forward chamber is filled after the lower chamber is substantially filled. Water is then constrained to enter the upper chamber through openings formed in said upper forward wall, said openings being relatively smaller and, with respect to circular and semi-circular openings, are more closely spaced apart than the openings formed in the lower forward wall. The openings formed in said upper forward wall are formed therein preferably near an upper edge thereof so that the forward chamber must be substantially filled before the upper chamber begins filling. The imperforate upper rearward wall then constrains the water to flow through the space between the trailing edge of the housing interior top wall ahd the housing rear wall as aforesaid and out the discharge opening.

It is a primary object of this invention to advance the art of waterfall-producing devices by disclosing a centerfed waterfall-producing device having a unique housing structure.

Another object is to accomplish the foregoing object with a device that is simple in structure and therefore economical to manufacture.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
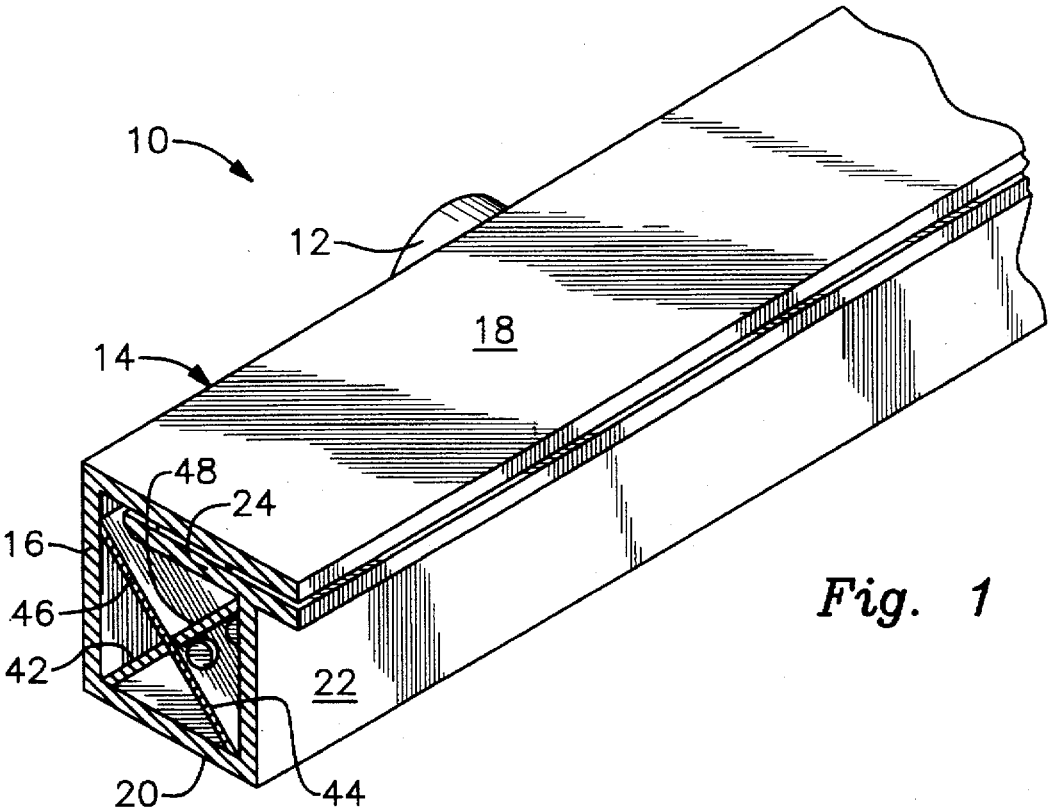
FIG. 1 is a front perspective view one embodiment of the novel device.
Figure 2:
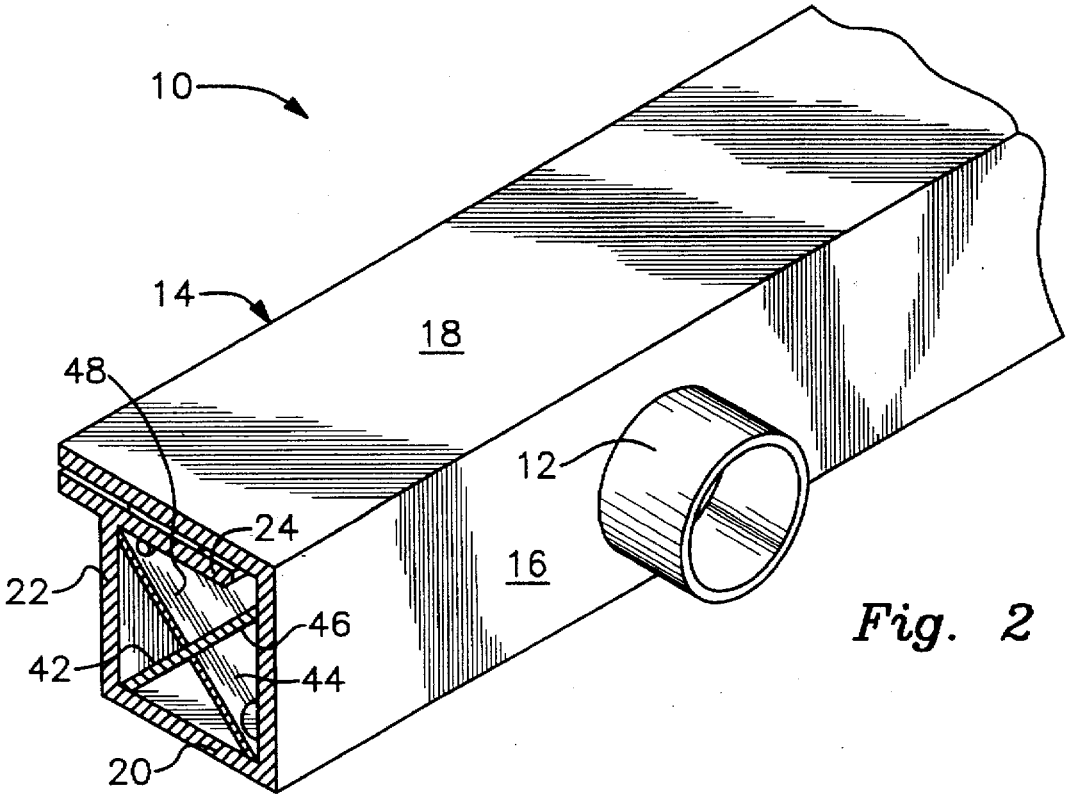
FIG. 2 is a rear perspective view of the same embodiment of the novel device.

Referring now to FIGS. 1 and 2, it will there be seen that an exemplary embodiment of the invention is denoted as a whole by the reference numeral 10.

inlet pipe 12 supplies water from a source of water under pressure to device 10 at its midpoint as depicted, i.e., device 10 is centerfed. Housing 14 of device 10 includes a flat, centrally apertured, upstanding rear wall 16 that receives inlet pipe 12. Housing 14 further includes a flat, imperforate, horizontal top wall 18, imperforate, horizontal bottom wall 20, imperforate, upstanding front wall 22, and imperforate, horizontal interior top wall 24. Imperforate, upstanding end walls, not shown, close the opposite ends of housing 14.

Figure 3:
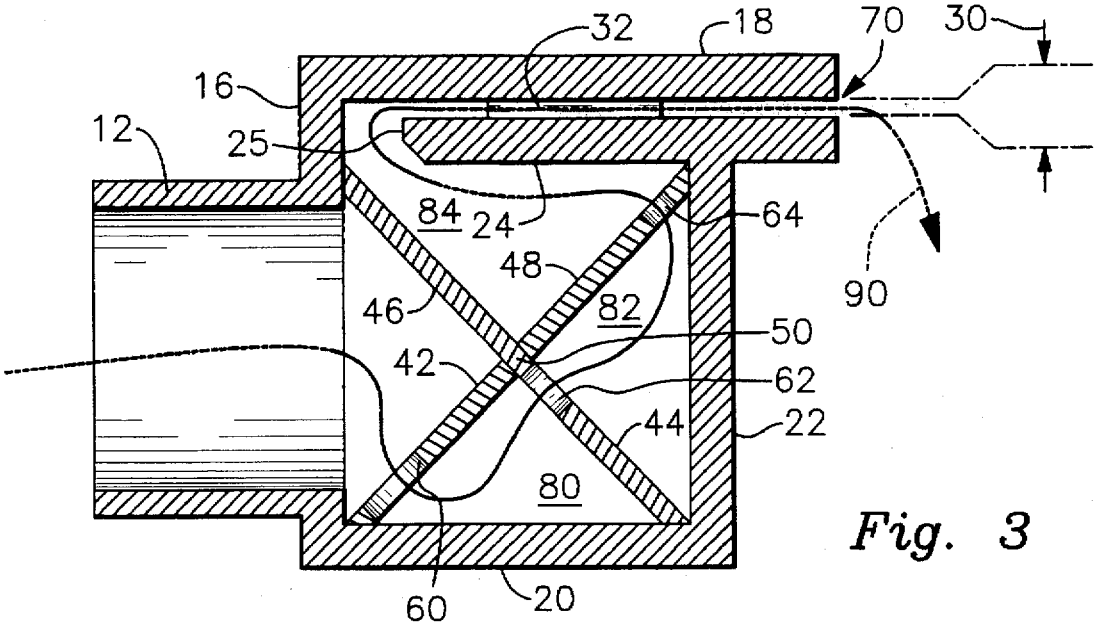
FIG. 3 is a transverse sectional view thereof.

The vertical distance, denoted 30 in FIG. 3, between top wall 18 and interior top wall 24, determines the thickness of the sheet of water expelled from device 10. In an illustrative embodiment, the spacing between said walls may be one-eighth inch. A plurality of upstanding spacers, denoted 32 in FIG. 3, may be positioned at predetermined, laterally spaced intervals along the extent of housing 14 if the housing is made of a warpable material such as plastic and is exposed to intense sunlight.

Figure 4:
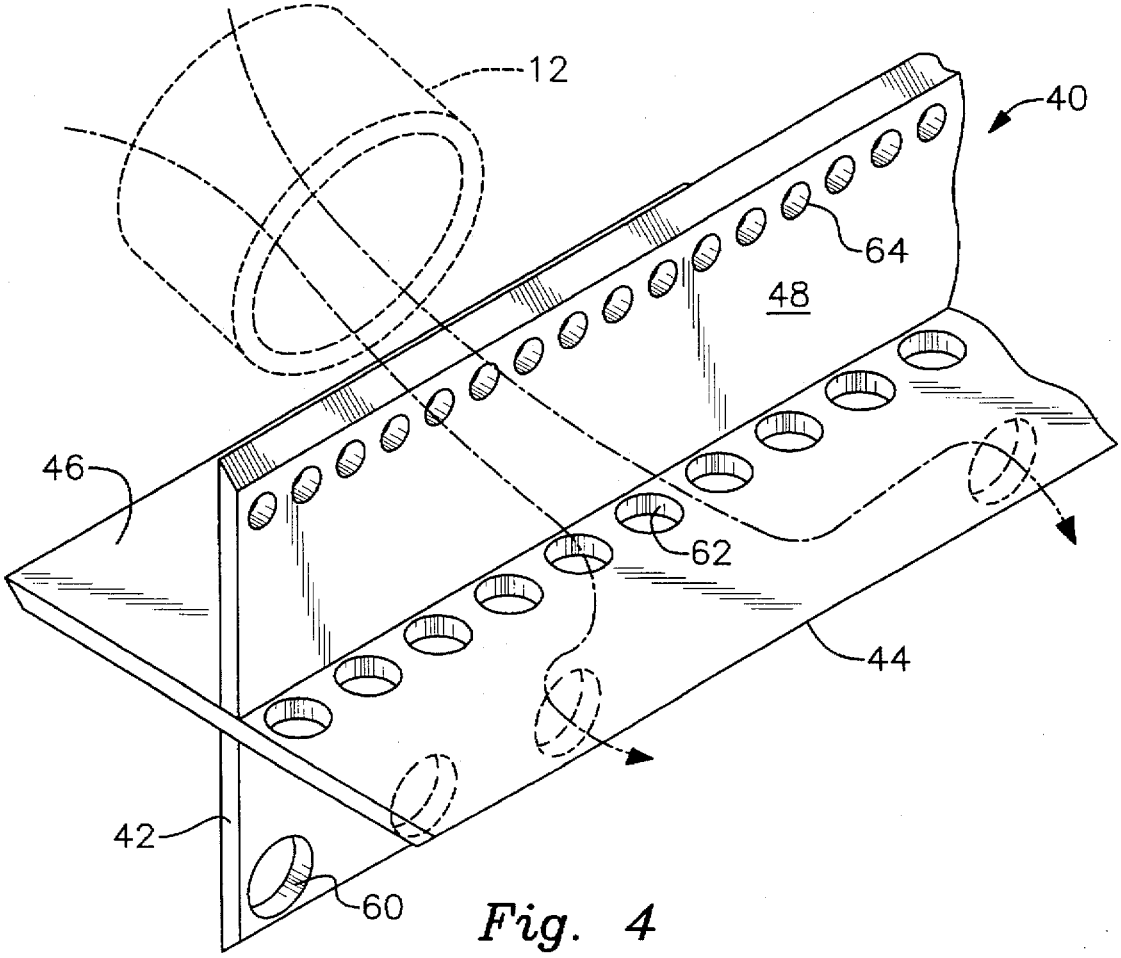
FIG. 4 is a perspective view of the interior baffle walls of the "X"-shaped turbulence suppressor device.

A novel turbulence-suppressing means, denoted 40 as a whole in FIG. 4, is positioned within housing 14 and extends the length thereof. It is slideably introduced into the interior of housing 14 before the final end wall is secured thereto.

Turbulence suppressor 40 has an "X"-shaped configuration as depicted. It is understood that the turbulence suppressor may be "t" (tee)-shaped. It may be fabricated in one piece, in two pieces, or more; the method selected for its fabrication is unrelated to this invention. However, for purposes of illustration and description, means 40 will be referred to as including a lower rearward wall 42, a lower forward wall 44, an upper rearward wall 46, and an upper forward wall 48. Each of said walls is disposed about forty five degrees relative to horizontal or vertical and each is substantially the same length, width, and thickness. Thus, centerpoint 50 of means 40 is substantially positioned at the center of the partial enclosure formed by housing rear wall 16, housing bottom wall 20, housing forward wall 22, and housing interior top wall 24. The enclosure is deemed "partial" due to the gap between the trailing edge 25 of interior top wall 24 of housing 14 and rear wall 16 of said housing 14.

A first plurality of water-admitting openings, collectively denoted 60, is formed in lower rearward wall 42, at spaced intervals along the extent thereof. In a preferred embodiment, the openings are circular and are equidistantly spaced with respect to one another. The openings may be circular as depicted, or they may be slotted semi-circular or of any other predetermined geometrical configuration. In a preferred embodiment, the collective area of the openings 60 is substantially equal to the area of opening 70 (FIG. 3) at the discharge of device 10. Thus, in a decorative waterfall four feet in lateral extent, and having a spacing 30 of one-eighth inch between top wall 18 and interior top wall 24, the area of opening 70 is six square inches (48 inches×⅛ inch). Thus, the collective area of openings 60 would be about the same.

A second plurality of water-admitting openings, collectively denoted 62, is formed in lower forward wall 44 at spaced intervals along the extent thereof. In a preferred embodiment, said openings 62 are circular and are equidistantly spaced with respect to one another, but said openings are spaced with respect to one another by a distance less than the spacings between circular openings 60 of lower rearward wall 42, and each opening 62 has less area than each opening 60. However, preferably, the collective area of openings 62 is substantially equal to the collective area of openings 60 and is thus substantially equal to the area of discharge area 70.

A third plurality of water-admitting openings, collectively denoted 64, is formed in upper forward wall 48 at spaced intervals along the extent thereof. In a preferred embodiment, said openings 64 are circular and are equidistantly spaced with respect to one another, but said openings are spaced with respect to one another by a distance less than the spacings between circular openings 62 of second wall 44, and each opening 64 has less area than each opening 62. However, preferably, the collective area of openings 64 is substantially equal to the collective area of openings 62 and is thus substantially equal to the area of discharge area 70.

Although device 10 will work if openings 60, 62, and 64 are formed anywhere in their respective walls 42, 44, and 48, the depicted positioning of said openings is the preferred positioning. Thus, openings 60 are formed near the lowermost edge of lower rearward wall 42, openings 62 are formed near the uppermost edge of lower forward wall 44, and openings 64 are formed near the uppermost edge of upper forward wall 48.

Accordingly, water entering housing 14 through pipe 12 is constrained to flow through openings 60 and to fill lower chamber 80 (FIG. 3), defined by walls 20, 42 and 44, from the bottom thereof. After lower chamber 80 has filled with water, said water can then flow through openings 62, as indicated by curvilinear single-headed directional arrow 90 in FIG. 3, to enter into forward chamber 82 (defined by walls 22, 44, 48). After forward chamber 82 has filled with water, water can flow into upper chamber 84, defined by walls 24, 46, 48, through openings 64. Since wall 46 is imperforate, and since the trailing edge 25 of interior top wall 24 is spaced apart from rear wall 16 as depicted, the water then flows into the space between interior top wall 24 and top wall 18 and hence out through discharge opening 70.

The resulting waterflow is a substantially even sheet of water having nominal turbulence. Walls 42, 44, 46, and 48 serve as baffle means for substantially inhibiting or suppressing the turbulence of the water before it exits device 10, and the size and spacing of the individual openings 60, 62, and 64 serve to supply an even supply of water along the extent of discharge opening 70.

Device 10 has the small size and structural simplicity of a dual inlet (endfed) device, but has the single water connection of a centerfed device. Thus, it provides a combination of the best features of the two most popular decorative waterfall structures.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for producing decorative waterfalls, comprising:

an elongate housing;

said elongate housing including a rear wall, a bottom wall, a forward wall, a top wall, an interior top wall disposed in spaced apart, parallel relation to said top wall, and a pair of end walls;

said interior top wall having a trailing edge disposed in spaced relation to said rear wall;

an elongate water discharge opening defined between a leading edge of said top wall and a leading edge of said interior top wall;

an elongate turbulence-suppressor disposed within said housing;

said elongate turbulence suppressor having a transverse cross-section comprising "T"-shaped or "X"-shaped configuration, and including a lower rearward wall, a lower forward wall, an upper rearward wall, and an upper forward wall;

a plurality of openings formed in said lower rearward wall, said lower forward wall, and said upper forward wall of said turbulence suppressor;

a rearward chamber defined by said rear wall of said housing and said lower rearward and upper rearward walls of said turbulence suppressor;

a lower chamber defined by said housing bottom wall and said lower rearward and lower forward walls of said turbulence suppressor;

a forward chamber defined by said housing forward wall and said lower forward and upper forward walls of said turbulence suppressor;

an upper chamber defined by said housing interior top wall and said upper rearward and upper forward walls of said turbulence suppressor;

whereby water from said source of water under pressure initially enters said rearward chamber, is constrained to flow sequentially into said lower chamber through said openings formed in said lower rearward wall, into said forward chamber through said openings formed in said lower forward wall, into said upper chamber through said openings formed in said upper forward wall, through said space between the trailing edge of said interior top wall and said rear wall, and through said discharge opening.

2. The device of claim 1, wherein said openings in said lower rearward wall have a collective area substantially equal in area to said discharge opening.

3. The device of claim 2, wherein said openings in said lower forward wall have a collective area substantially equal in area to said discharge opening.

4. The device of claim 3, wherein said openings in said upper forward wall have a collective area substantially equal in area to said discharge opening.

5. The device of claim 4, wherein said openings in said lower rearward wall have a common area and are equidistantly spaced apart by a predetermined distance.

6. The device of claim 5, wherein said openings in said lower forward wall are circular and have a common area less than the common area of said openings in said lower rearward wall are circular and are equidistantly spaced apart from one another by a predetermined distance that is less than the predetermined distance between said openings in said lower rearward wall.

7. The device of claim 6, wherein the openings in said upper forward wall have a common area less than the common area of said openings in said lower forward wall and are equidistantly spaced apart from one another by a predetermined distance that is less than the predetermined distance between said openings in said lower forward wall.

8. The device of claim 7, wherein said openings in said lower rearward wall are positioned near a lower edge of said lower rear wall.

9. The device of claim 8, wherein said openings in said lower forward wall are positioned near an upper edge of said lower forward wall.

10. The device of claim 9, wherein said openings in said upper forward wall are positioned near an upper edge of said upper forward wall.

* * * * *